US006419168B1

(12) United States Patent
Thieleke et al.

(10) Patent No.: US 6,419,168 B1
(45) Date of Patent: Jul. 16, 2002

(54) METERING HEAD

(75) Inventors: Joachim Thieleke, Wasserburg; Kaveh Towfighi, Sigmarszell, both of (DE); Iwan Wolf, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/684,752

(22) Filed: Oct. 6, 2000

(30) Foreign Application Priority Data

Oct. 19, 1999 (DE) ..... 199 50 350

(51) Int. Cl.[7] ..... B05B 7/32

(52) U.S. Cl. ..... 239/337; 239/338; 239/350; 239/354; 239/355; 239/358; 239/548

(58) Field of Search ..... 239/333, 337, 239/338, 346, 350, 354, 355, 358, 548; 222/402.1, 402.13, 402.2

(56) References Cited

U.S. PATENT DOCUMENTS

| | | | | |
|---|---|---|---|---|
| 2,973,123 A | * | 2/1961 | Rousset | |
| 3,176,890 A | * | 4/1965 | Potapenko et al. | |
| 3,596,800 A | * | 8/1971 | Iketani | 239/350 X |
| 3,628,733 A | * | 12/1971 | Kahn | 239/337 |
| 4,257,560 A | * | 3/1981 | Diamond | 239/337 |
| 5,735,465 A | * | 4/1998 | Laforcade | 239/337 |
| 6,149,077 A | * | 11/2000 | Pohler | 239/337 |

* cited by examiner

*Primary Examiner*—Robin O. Evans
(74) *Attorney, Agent, or Firm*—Sidley Austin Brown & Wood, LLP

(57) ABSTRACT

A metering head for delivering a liquified fuel gas in different combustion chamber sections of a tool and including an inlet (8), at least two outlets (16, 17), and at least one metering valve **(5, 5*a*, 5*b*) connecting the inlet (8) with the at least two outlets (16, 17)**.

5 Claims, 5 Drawing Sheets

METERING HEAD

BACKGROUND OF THE INVENTION

1. Field of the Invention

The present invention relates to a metering head for delivering liquified fuel gas in different combustion chambers of an internal combustion-engined tool, in particular of a setting tool for driving fastening elements in an object.

2. Description of the Prior Art

In setting tools for driving fastening elements in an object, the drive-in energy is obtained as a result of burning, e.g., an air-fuel gas mixture. This energy is transmitted by a piston to a fastening element, e.g., a nail, a bolt, or the like. The air-fuel gas mixture fills, possibly with different ratio of mixture ingredients, separate sections of the combustion chamber. The separate combustion chamber sections communicate with each other through openings formed in the combustion chamber walls which separate the combustion chamber sections from each other.

The combustion in a first, rear with respect to the driving piston, combustion chamber section is initiated by a spark produced by an electrical ignition device. The produced flame front spreads in the first combustion chamber section with a relatively low speed. The non-consumed air-fuel gas mixture is pushed by the flame front ahead of it and enters through the respective openings into the next combustion chamber section, producing there turbulence and pre-compression.

When the flame front reaches the openings connecting the first combustion chamber section with the next combustion chamber section, flame enters the next chamber in a form of flame jets due to the small cross-section of the openings. The flame jets increase the turbulence in the next combustion chamber section which was originally produced by non-consumed mixture that entered the next combustion chamber section before. The intermixed, turbulent, air-fuel gas mixture is then ignited in the next combustion chamber section over the entire surface of the separate flame jets. The mixture burns with a high speed which substantially increases the combustion efficiency as the cooling losses are small. The obtained drive energy acts on the piston which limits the next combustion chamber section (which is sometimes called a main combustion chamber section) and which transmits the drive energy to a fastening element. German Publication DE 40 32 202 discloses an internal combustion-engined setting tool for driving in of fastening elements in which the air-fuel gas mixture is aspirated into the combustion chamber section by expansion of the combustion chamber section. Therefore, the air-fuel gas mixture cannot be fed separately in the separate combustion chamber sections. This does not permit an optimal operation of the tool. Moreover, the aspiration of the fuel gas-air mixture in a combustion chamber section by its expansion does not insure that each of the combustion chamber sections contain an ignitable air-fuel gas mixture.

Accordingly, an object of the present invention is to provide a metering head which would make possible to deliver air-fuel gas mixture into different combustion chamber sections simultaneously.

SUMMARY OF THE INVENTION

This and other objects of the present invention, which will become apparent hereinafter, are achieved by providing a metering head having an inlet, at least two outlets, and a metering valve or valves connecting the inlet with the at least two outlets. With a metering head according to the present invention, the separate outlets permit to supply an individually metered amount of the fuel gas in a liquid form into each of the combustion chamber sections. That permits to form, in respective combustion chamber sections, separate ignitable mixtures in accordance with the desired operational conditions of the internal combustion-engined tool. Thereby, the operational reliability and efficiency of the tool are increased. The present invention permits to obtain an ignitable gas mixture, e.g., air-fuel gas mixture, oxygen-fuel gas mixture and the like in all of the combustion chamber sections under all conditions.

When a single metering valve connects the common inlet of the metering head with several outlets, an individual metering per an outlet can be provided, e.g., by forming the outlets with different cross-sections.

When the metering head has two or more metering valves, which are connected with the common inlet and with one or more outlets, respectively, the individual metering per outlet can be provided by a selection of the metered volume of each respective metering valve. This can be effected by using metering valves having metering chambers with different volumes. In addition, the cross-sections of the outlets can be varied, if necessary.

For metering the fuel gas in form of a mist, the outlets can be formed as nozzles. This provides or insures a better evaporation of the liquified fuel gas and, thereby, better intermixing. The us of nozzles also permits to obtain a desired gas mixture, e.g., of the fuel gas and air.

To simplify to a most possible extent the construction of the inventive metering head, the inlets of the metering chambers of all of the metering valves can be permanently connected with the metering head inlet. The metering head inlet can be surrounded by, e.g., resilient projections for mounting the metering head on a bottle containing fuel gas. The projection can engage, e.g., from below circumferential flange at the bottle outlet. In this case, the inlet of the metering head impacts the outlet valve of the bottle, opening the same. In this way, the metering chamber or chambers of the metering valve(s) is (are) permanently filled with fuel gas through the metering chamber inlets.

The metering valve(s) can be so arranged inside of the metering head that its (their) longitudinal axis (axes) extend (s) transverse to the axis of the outlet. In this case, the inlets and outlets of the metering chambers of the metering valves can be opened and closed by displacing the metering head inlet relative to the metering head housing in a direction of the longitudinal axis of the outlets. This can be effected, e.g., by lifting the bottle, i.e., by moving it up and down. The movement of the gas bottle can be coordinated with the operational process of the setting tool the combustion chamber sections of which are filled with fuel gas by the metering head.

In accordance with another embodiment of the present invention, the metering valves of the metering head can be so arranged that their longitudinal axes extend parallel to the longitudinal axis of the outlet. In this case, the opening and closing of the inlets and outlets of the metering chambers of the metering valves can be effected by displacement of the metering valves relative to the outlets in the direction of their longitudinal axes. In this case, e.g., the outlets of the metering head are fixedly secured in the walls of the respective combustion chamber sections, and only those parts of the metering head are movable which carry the metering valves. The movable parts are displaced in accordance with the operational process of the setting tool the combustion chamber sections of which are filled with the fuel gas by the metering head. In this case, the parts of the metering head carrying the metering valves, and the gas bottle, which is in fluid communication with the metering head inlet, are fixedly connected with each other.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
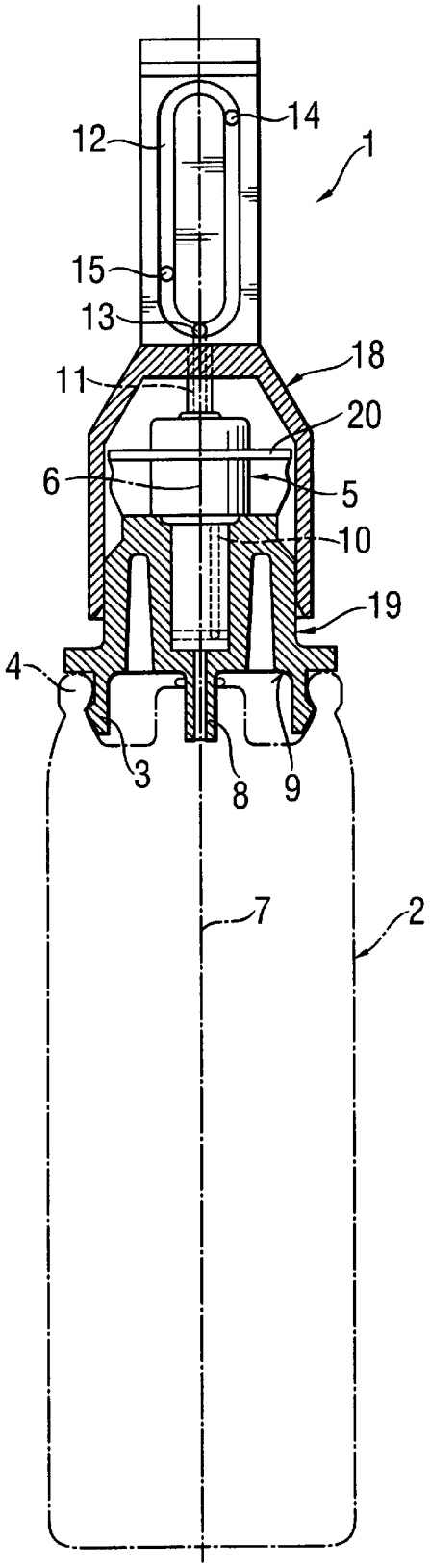
FIG. 1 a cross-sectional view of a metering head according to the present invention with a metering valve and two outlets and with the head inlet connected with a gas bottle.

In the embodiment of a metering head according to the present invention, which is shown in FIG. 1, the metering head 1 is fixedly secured on a gas bottle 2 containing liquified fuel gas. For securing of the metering head 1 on the bottle 2, there are provided, in the lower region of the metering head 1, resilient hooks 3 which extend downwardly from the lower portion of the metering head 1 and engage beneath a circumferential head 4 of the upper end side of the gas bottle 2.

Inside of the metering head 1, there is located a metering valve 5 a longitudinal axis 6 of which coincides with a longitudinal axis 7 of the gas bottle 2. A ventilation chamber (not shown) of the metering valve 5 has its inlet side connected with hollow pin 8 which extend from a bottom 9 of the metering head 1. When the metering head 1 is secured on the gas bottle 2, the hollow pin 8 engages in the outlet valve of the gas bottle 2, opening the valve. Liquified gas flows from the gas bottle 2 through the hollow pin 8 into a channel 10 of the metering valve 5, reaching the metering chamber of the metering valve 5. The metering chamber of the metering valve 5 is constantly filled through its inlet with the fuel gas when the metering head 1 is secured on the gas bottle 2 and is not actuated. The outlet of the metering chamber of the metering valve 5 remains closed and becomes open only when needed, with the inlet of the metering chamber being closed for a short time.

The outlet of the metering chamber of the metering valve 5 is connected with an annular channel 12 by an outlet channel 11 of the metering valve 5 and a connection channel 13. Two transverse channels 14 and 15 open, respectively, into two spout-out nozzles 16 and 17.

The annular channel 12, the connection channel 13, and the transverse channels 14 and 15 are all located in a cap portion 18 of the metering head 1. The lower region of the cap portion 18 circumscribes the metering head chamber containing the metering valve 5 and the bottom member 19 of the metering head 1 which carries the metering valve 5. The bottom member 19 is displaceable along the longitudinal axis 6 of the metering valve 5. The hooks 3 and the hollow pin 8, which were discussed above, are provided on the bottom member 19 and, e.g., are formed integrally therewith.

The outlet channel 11 of the metering valve 5 extends along the metering valve axis 6 and is dischargeable in a correspondingly extending portion of the connection channel 13. When the gas bottle 2 is lifted and the bottom member 19 is pushed into the cap portion 18, an outer flange 20 of the metering valve 5 is lifted, which results in the inlet valve of the metering valve 5 being closed and the outlet valve of the metering valve 5 being open, with a metered volume of the liquefied fuel gas reaching the spout-out nozzles 16, 17. The spout out. nozzles 16, 17 are located in cylindrical members 21, 22 connected with the cap portion 18. The cylindrical members 21, 22 are provided with outer sealing rings 23, 24, respectively, and therewith are sealingly inserted in corresponding openings formed in the wall of a combustion chamber of a setting tool. The cap portion 18 is fixedly connected to this wall. The longitudinal axes 25, 26 of the spout-out nozzles 16, 17, which form outlets of the metering head 1, extend transverse to the longitudinal axis 6 of the metering valve 5. Upon lowering of the gas bottle 2, the bottom member 19 which is fixedly connected with the gas bottle 2 as described above, also moves downwardly. The downward movement of the bottom member 19 results in closing of the outlet of the metering chamber 5 and opening of its inlet, and the metering chamber of the metering valve 5 is again filled with the liquified fuel gas.

Figure 2:
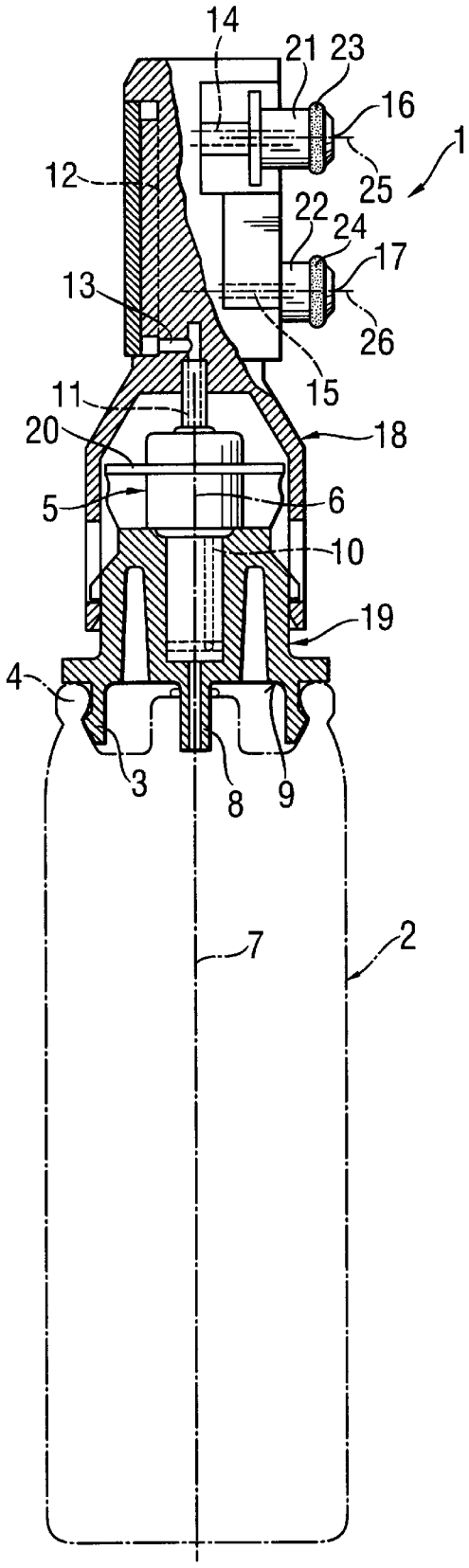
FIG. 2 a cross-sectional view of the metering head shown in FIG. 1 with the cross-section taken at an angle of 90° to the cross-section shown in FIG. 1.
Figure 4:
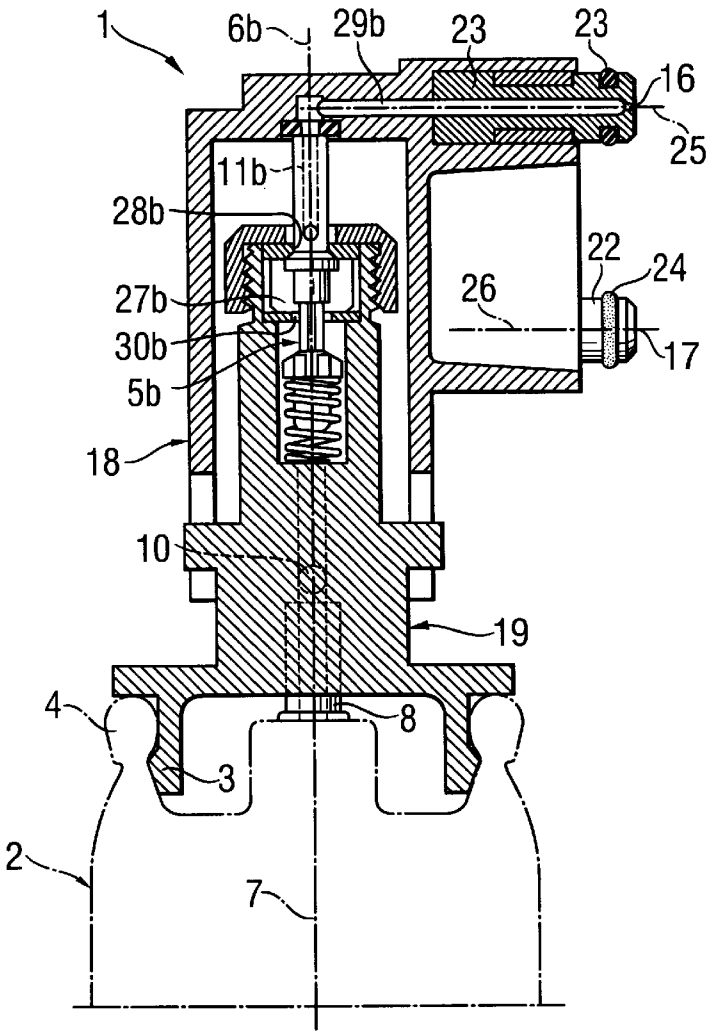
FIG. 4 a cross-sectional view of a the metering head shown in FIG. 3 with the cross-section taken at an angle of 90° to the cross-section shown in FIG. 3.
Figure 3:
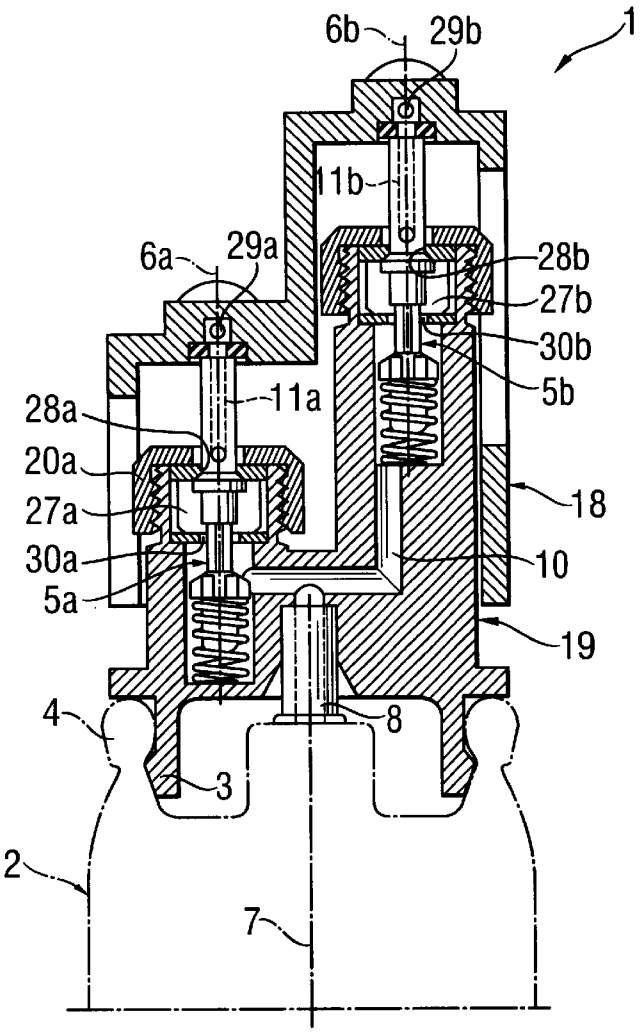
FIG. 3 a cross-sectional view of a metering head according to the present invention with two metering valves arranged in a longitudinal direction of a gas bottle with which the metering head is connected, and two outlets.
Figure 5:
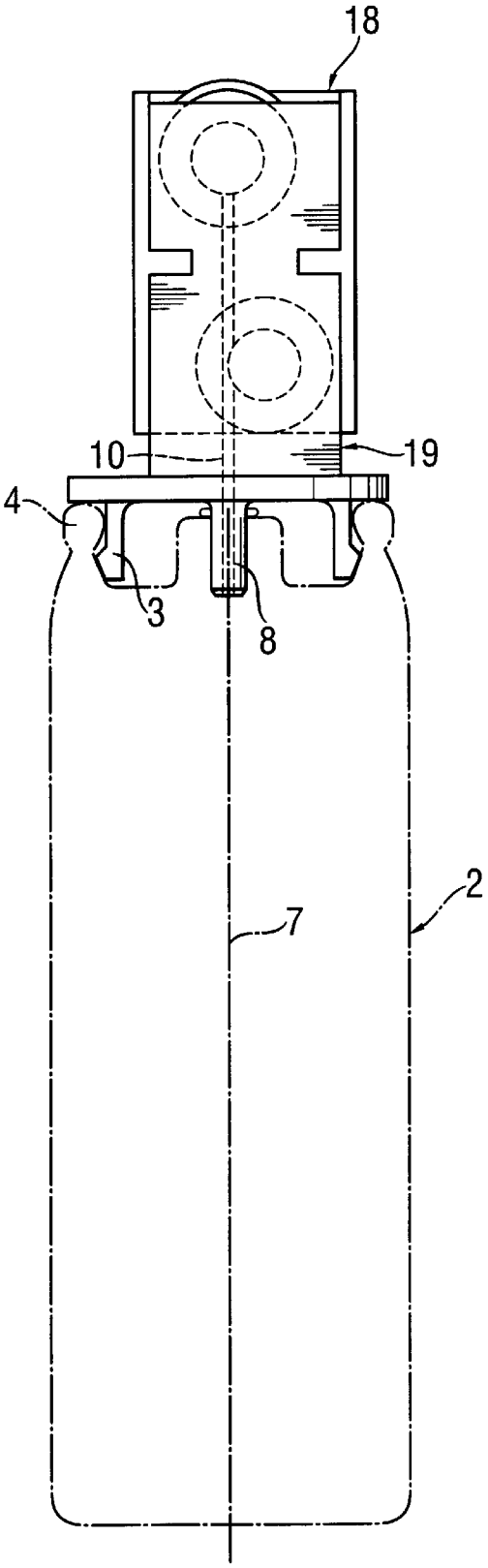
FIG. 5 a cross-sectional view of a the metering head according to the present invention with two metering valves arranged transverse to a longitudinal direction of a gas bottle, with which the metering head is connected, and two outlets.
Figure 6:
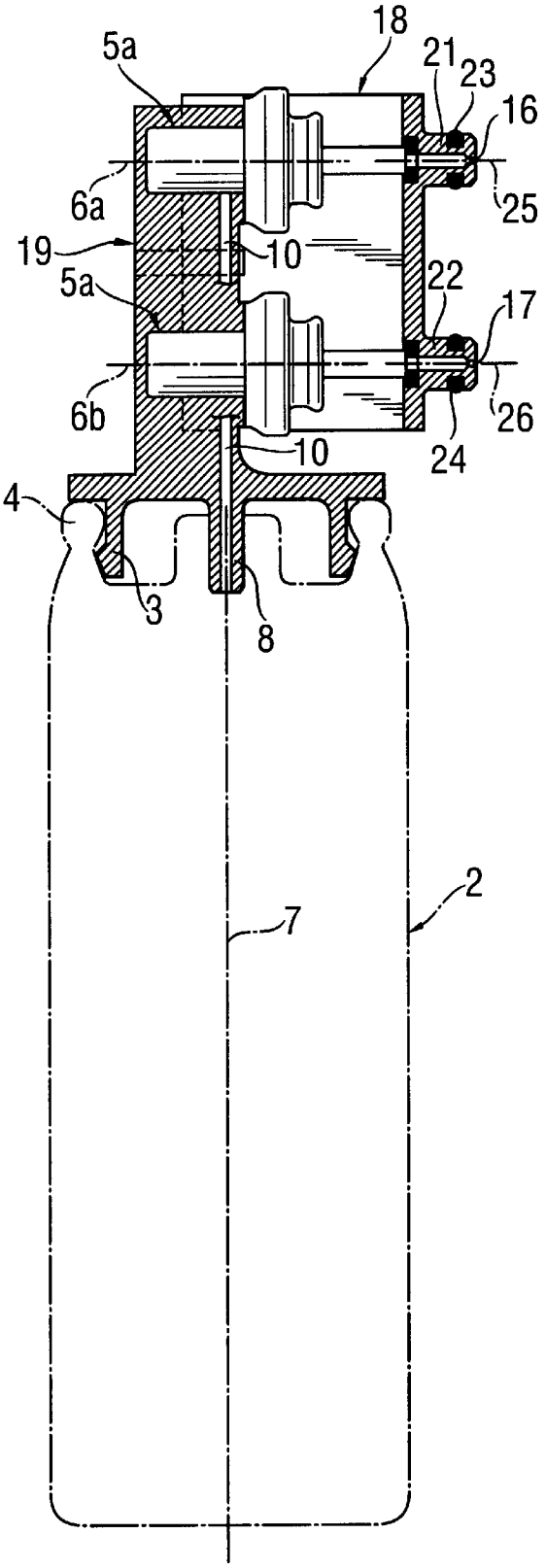
FIG. 6 a cross-sectional view of a the metering head shown in FIG. 5 with the cross-section taken at an angle of 90° to the cross-section shown in FIG. 5.

FIGS. 3–4 show a second embodiment of the metering head according to the present invention. In FIGS. 3–4, the elements of the metering head 1 identical with those shown in FIGS. 1–2, are designated with the same reference numerals and will not be further described.

The embodiment of the metering head 1 shown in FIGS. 3–4 differs from that shown in FIGS. 1–2 in that the metering head 1 has two metering valves 5*a* and 5*b* the longitudinal axes 6*a* and 6*b* of which are spaced from each other and extend parallel to the longitudinal axis 7 of the gas bottle 2. The metering head 1 is fixedly secured on the gas bottle 2, and the bottom member 19 is not displaceable relative to the cap portion 18. The metering chambers 27*a*, 27*b* of the two metering valves 5*a*, 5*b* are thereby permanently and simultaneously filled with the liquified fuel gas through the hollow pin and the channel 10 provided in the bottom number 19. The inlets 30*a*, 30*b* of the metering chambers 27*a*, 27*b* of the valves 5*a*, 5*b* remain open, as it, particularly can be seen in FIG. 3.

Outlets 28*a* and 28*b* of the metering chambers 27*a*, 27*b* of the metering valves 5*a*, 5*b* are still closed in the position shown in FIG. 3. The outlets 28*a* and 28*b* are connected, respectively, via the connection channels 11*a*, 11*b*, with transverse channels 29*a*, 29*b* which, in turn, open into nozzles 16, 17, respectively. The connection channels 11*a*, 11*b* are connected with the transverse channels 29*a*, 29*b* at the edges of the transverse channels 29*a*, 29*b*. When with the stationary cap member 18, the gas bottle 2 is pushed in the direction toward the cap member 19, the bottom member 19 is displaced partially thereinto. This results in closing of the inlets 30*a*, 30*b* of the metering chambers 27*a*, 27*b* and in opening of the outlets, 28*a*, 28*b*. This provides for the flow of the liquified fuel gas toward the nozzles 16, 17. Upon release of the gas bottle 2, the bottom member 19 moves out of the cap member 18 which results in closing of the outlets 28*a*, 28*b* of the metering chambers 27*a*, 27*b* and in opening of the respective inlets 30*a*, 30*b*. With this process, the members 21, 22, in which the nozzles 16, 17 are located, are fixedly secured in the wall of the combustion chamber of the setting tool, whereby the cap member 18 is fixedly positioned.

The structure of the metering valve itself will be discussed in more detail below with reference to FIG. 9.

A third embodiment of a metering head 1 according the present invention is shown in FIGS. 5–8. In this embodiment, the metering valves 5*a*, 5*b* are so arranged that their longitudinal axes 6*a*, 6*b* extend transverse to the longitudinal axis 7 of the gas bottle 2. In FIGS. 5–8, the elements of the metering head 1 identical with those of FIGS. 1–4 are again designated with the same reference numerals and will not be discussed in detail.

In the embodiment shown in FIGS. 5–8, the metering chambers 27*a*, 27*b* of the metering valves 5*a*, 5*b* are connected, as in the previous embodiments, with the hollow pin 8 via the channel 10. The metering chambers 27*a*, 27*b* become filled with the liquified fuel gas when the outlet 28*a*, 28*b* are not in communication with the metering chambers 27*a*, 27*b* and are quali closed. In this case, no fuel gas flows to the nozzles 16, 17. The outlet channels 11*a*, 11*b*, which are connected with outlets 28*a*, 28*c*, at their rear end, open into a front plate 18*a* of the cap member 18, with the channels 11*a*, 11*b* being sealed relative to the plate 18.

The outlet channels 11*a*, 11*b* are connected with the nozzles 16 and 17. The cylindrical members 21, 22, which house the nozzles 16, 17, respectively, are formed integrally with the front plate 18*a* and have inner channels 16*a*, 17*a* which lead from the nozzles 16, 17 to the outlets channels 11*a*, 11*b*. The connections between the front plate 18*a* and the outlet channels 11*a*, 11*b* are fluid-tight, at least in the edge region of the outlet channels 11*a*, 11*b*. The front plate 18*a* extends transverse to the longitudinal axes 6*a*, 6*b* of the metering valves 6*a*, 6*b*, with the cylindrical members 21, 22 being inserted in respective openings in the combustion chamber wall. The bottom member 19 is fixed to the gas bottle 2 and is displaceable toward the front plate 18*a* in accordance with the operational cycle of the setting tool the combustion chamber of which has to be filled with the fuel gas through the nozzles 16, 17. The operation of the drive mechanism of the bottom member 19 along the axes 6*a*, 6*b* or 25, 26 can be controlled by the control unit of the setting tool.

Figure 8:
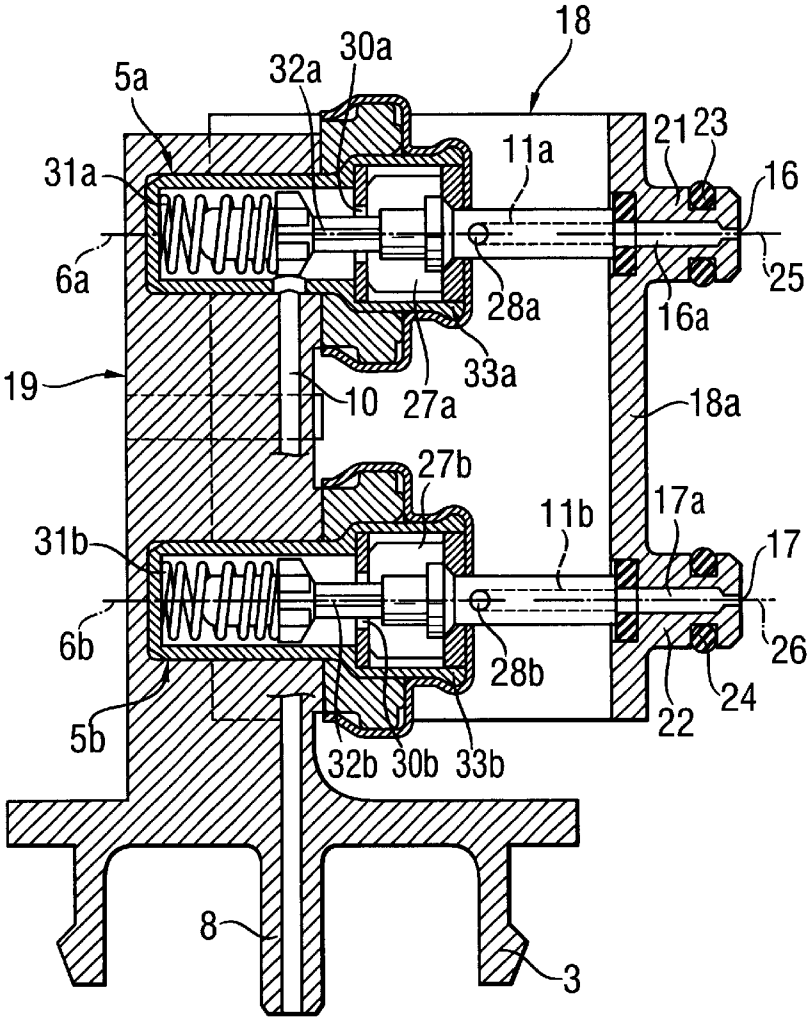
FIG. 8 a view showing the metering head as shown in FIG. 6 at an increased scale.
Figure 7:
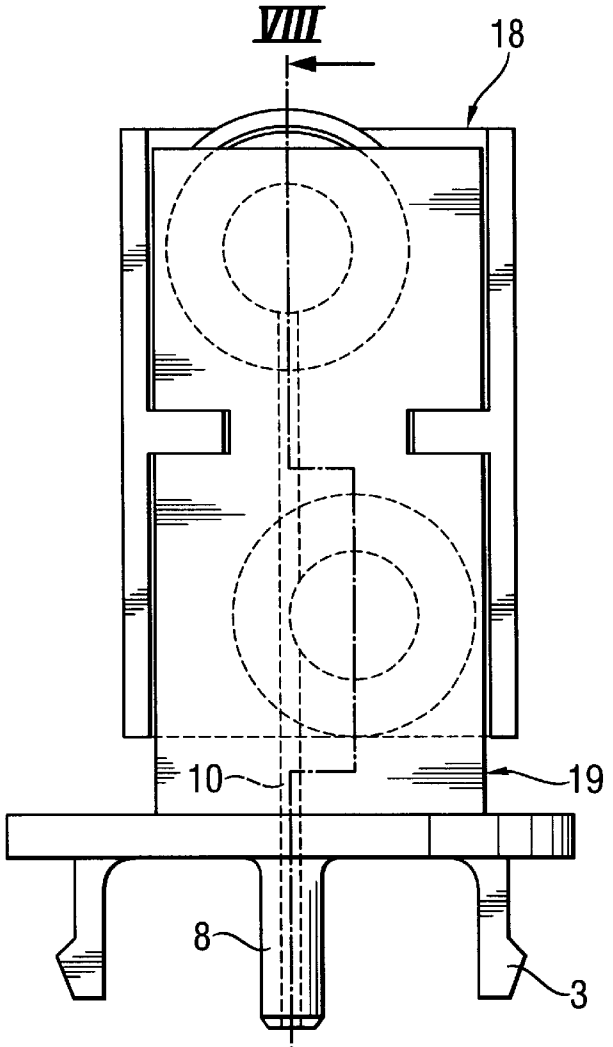
FIG. 7 a view showing the metering head as shown in FIG. 5 at an increased scale.

With the bottom member 19 remaining stationary, i.e., in position in which it is not pushed toward the front plate 18, the liquified fuel gas flows from the gas bottle 2 into the metering chambers 27*a*, 27*b* via the hole pin 8 and the channel 10. The inlets 30*a*, 30*b* are open, as can be seen in FIG. 8. The outlets 28*a*, 28*b* are located outside of the respective metering chambers 27*a*, 27*b* and are closed. Springs 31*a*, 31*c*, which are supported against the bottom member 19, bias the valve tappets 32*a*, 32*b* permanently into a position in which the inlets 30*a*, 30*b* remain open. On the other hand, the outlet channels 11*a*, 11*b*, which sit on the valve tappets 32*a*, 32*b*, are supported against the front plate 18*a*. When the bottom member 19 is pushed toward the front plate 18*a*, the measuring chamber housings 33*a*, 33*b*, which are connected with the bottom member 19, are displaced therewith and close respective inlets 30*a*, 30*b*. The housings 33*a*, 33*b* are displaced past the outlets 28*a*, 28 so the later are located inside the respective metering chambers 28*a*, 28*b*. The fuel gas, which fills the metering chambers 27*a*, 27*b*, flows therefrom via the outlets 28*a*, 28*b* and the outlet channels 11*a*, 11*b* to the nozzles 16, 17. Upon release of the bottom member 19, the measuring chamber housings 33*a*, 33*b* move downward, closing the outlets 28*a*, 28*b*. The springs 31*a*, 31*b* retain the valve tappets 32*a*, 32*b* in a position in which the inlets 30*a*, 30*b* remain open.

Figure 9:
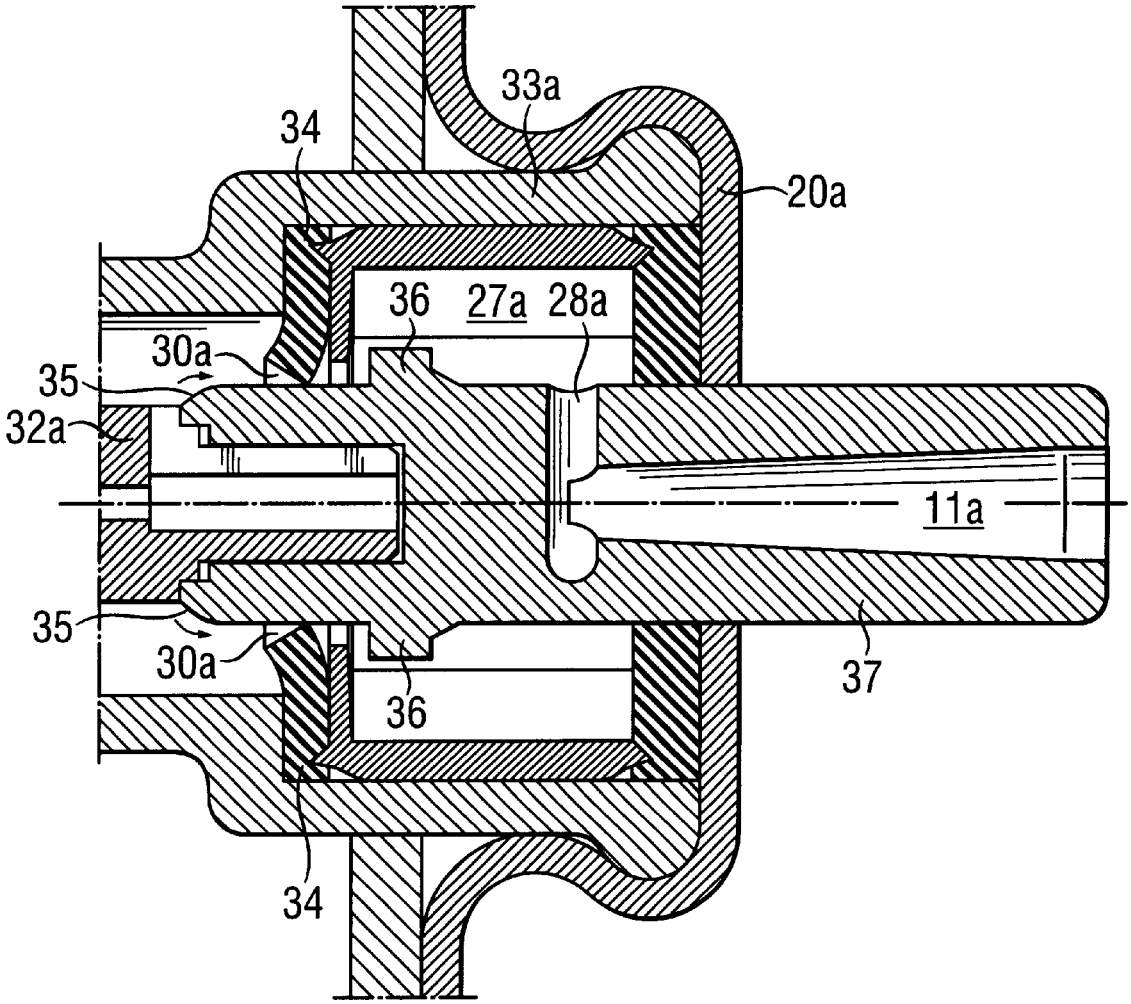
FIG. 9 a partial cross-sectional view showing the region of inlet and outlet of the metering valve.

FIG. 9 shows an axial cross-sectional view of the metering valve. The valve tappet 32*a* carries a cylinder 37 provided with the outlet channel 11*a* and the transverse channel defining the outlet 28*a*. The housing 33*a* define the metering chamber 27*a* and is provided with a resilient sealing 34 in which the valve tappet 32*a* is received. A flange 20*a* holds the housing 33*a* in engagement with the bottom member 19. The free end of the outlet channel 11*a* is in contact with the front plate 18*a* of the cap member 18. The cylinder 37, in which the outlet channel 11*a* is formed, is biased against the front plate 18*a* by the spring 31*a* supported against the bottom member 19 and acting on the valve tappet 32*a*.

FIG. 9 shows a position of the metering chamber housing 33*a* relative to the outlet channel 11*a*, in which the transverse outlet channel 28*a* is located inside of the metering chamber 27*a*. In this position, the outlet 28*a* is open so that the fuel gas, which fills the metering chamber 27*a*, can flow through the channels 28*a* and 11*a*. Upon release of the bottom member 19, the flange 20*a* is pulled relative to the valve tappet 32*a* or the outlet channel 11*a* rearwardly, with the flange 20*a* being pulled, with respect to the transverse channel 28*a*, leftwards until it is located behind the outlet 28*a* (the transverse channel). Thereby the outlet 28*a* becomes closed. Simultaneously or shortly thereafter, the resilient sealing 34 of the metering chamber housing 33*a* is displaced over the chambered rear edge 35 of the cylinder 37, whereby a clearance is formed between the edge 35 and the resilient sealing 34 through which the fuel gas can flow into the chamber 27*a* through the inlet 30*a* which is defined by the formed clearance. The downward movement of the flange 20*a* is limited by a stop 36 provided on an outerside of the cylinder 37.

Though the present invitation was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A metering head for delivering a liquified fuel gas in different combustion chamber sections of a tool from a liquified fuel gas-containing bottle (2) having a circumferential head (4), the metering head comprising an inlet (8) provided in a lower portion of the metering head; at least two outlets (16, 17); at least one metering valve (5, 5*a*, 5*b* ) for connecting the inlet (8) with the at least two outlets (16, 17); and a plurality of resilient projections (3) surrounding the inlet (8) and extending downwardly from the lower portion of the metering head for engaging the circumferential head (4) of the bottle (2) from beneath.

2. A metering head accordingly to claim 1, further comprising a hollow pin extending downwardly from a bottom of the metering head for opening an outlet value of the bottle (2) engaging the circumferential head (4) of the bottle (2) and for delivering the liquified fuel gas to the inlet (8).

3. A metering head according to claim 1, wherein the at least one metering valve (5) has a longitudinal axis (6) that extends at least approximately transverse to longitudinal axes of the at least two outlets (16, 17).

4. A metering head according to claim 1, wherein the outlets (16, 17) are formed as spout-out nozzles.

5. A metering head according to claim 1, wherein the at least two outlets (16, 17) have different sizes.

* * * * *